US006032114A

United States Patent [19]

Chan

[11] Patent Number: 6,032,114

[45] Date of Patent: Feb. 29, 2000

[54] METHOD AND APPARATUS FOR NOISE REDUCTION BY FILTERING BASED ON A MAXIMUM SIGNAL-TO-NOISE RATIO AND AN ESTIMATED NOISE LEVEL

[75] Inventor: Joseph Chan, Tokyo, Japan

[73] Assignee: Sony Corporation, Tokyo, Japan

[21] Appl. No.: 08/606,001

[22] Filed: Feb. 12, 1996

[30] Foreign Application Priority Data

Feb. 17, 1995 [JP] Japan ..... 7-029336

[51] Int. Cl.[7] ..... G10L 3/02

[52] U.S. Cl. ..... 704/226

[58] Field of Search ..... 395/2.09, 2.1, 395/2.14, 2.33, 2.34, 2.35–2.37

[56] References Cited

U.S. PATENT DOCUMENTS

| | | | |
|---|---|---|---|
| 4,628,529 | 12/1986 | Borth et al. | 381/94 |
| 4,630,304 | 12/1986 | Borth et al. | 381/94 |
| 4,630,305 | 12/1986 | Borth et al. | 381/94 |
| 5,007,094 | 4/1991 | Hsueh et al. | 704/226 |
| 5,012,519 | 4/1991 | Adlersberg et al. | 381/46 |
| 5,097,510 | 3/1992 | Graupe | 704/233 |
| 5,150,387 | 9/1992 | Yoshikawa et al. | 375/122 |
| 5,212,764 | 5/1993 | Ariyoshi | 395/2 |
| 5,228,088 | 7/1993 | Kane et al. | 395/2 |
| 5,479,560 | 12/1995 | Mekata | 395/2.18 |
| 5,544,250 | 8/1996 | Urbanski | 395/2.36 |
| 5,612,752 | 3/1997 | Wischermann | 348/701 |
| 5,617,472 | 4/1997 | Yoshida et al. | 379/390 |
| 5,668,927 | 9/1997 | Chan | 704/240 |

FOREIGN PATENT DOCUMENTS

| | | | |
|---|---|---|---|
| 0451796 | 10/1991 | European Pat. Off. . | |
| 0556992 | 8/1993 | European Pat. Off. . | |
| 0637012A2 | 2/1995 | European Pat. Off. | G10L 3/02 |
| WO9502288 | 1/1995 | WIPO | H04B 15/00 |

*Primary Examiner*—David R. Hudspeth
*Assistant Examiner*—Michael N. Opsasnick
*Attorney, Agent, or Firm*—Jay H. Maioli

[57] ABSTRACT

A method for reducing the noise in an speech signal by removing the noise from an input speech signal is disclosed. The noise reducing method includes converting the input speech signal into a frequency spectrum, determining filter characteristics based upon a first value obtained on the basis of the ratio of a level of the frequency spectrum to an estimated level of the noise spectrum contained in the frequency spectrum and a second value as found from the maximum value of the ratio of the frame-based signal level of the frequency spectrum to the estimated noise level and the estimated noise level, and reducing the noise in the input speech signal by filtering responsive to the filter characteristics. A corresponding apparatus for reducing the noise is also disclosed.

4 Claims, 9 Drawing Sheets

METHOD AND APPARATUS FOR NOISE REDUCTION BY FILTERING BASED ON A MAXIMUM SIGNAL-TO-NOISE RATIO AND AN ESTIMATED NOISE LEVEL

BACKGROUND OF THE INVENTION

This invention relates to a method for removing the noise contained in a speech signal and for suppressing or reducing the noise therein.

In the field of portable telephone sets or speech recognition, it is felt to be necessary to suppress noise such as background noise or environmental noise contained in the collected speech signal for emphasizing its speech components.

As a technique for emphasizing the speech or reducing the noise, employing a conditional probability function for attenuation factor adjustment is disclosed in R. J. McAulay and M. L. Maplass, "Speech Enhancement Using a Soft-Decision noise Suppression Filter," in IEEE Trans. Acoust., Speech Signal Processing, Vol. 28, pp. 137 to 145, April 1980.

In the above noise-suppression technique, it is a frequent occurrence that unspontaneous sound tone or distorted speech is produced due to an inappropriate suppression filter or an operation based upon an inappropriate fixed signal-to-noise ratio (SNR). It is not desirable for the user to have to adjust the SNR, as one of the parameters of a noise suppression device, in actual operation for realizing an optimum performance. In addition, it is difficult with the conventional speech signal enhancement technique to eliminate the noise sufficiently without generating distortion in the speech signal that is susceptible to significant variation in the SNR in short time.

Such speech enhancement or noise reducing technique employs a technique of discriminating a noise domain by comparing the input power or level to a pre-set threshold value. However, if the time constant of the threshold value is increased with this technique for prohibiting the threshold value from tracking the speech, a changing noise level, especially an increasing noise level, cannot be followed appropriately, thus leading occasionally to mistaken discrimination.

For overcoming this drawback, the present inventors have proposed in JP Patent Application Hei-6-99869 (1994) a noise reducing method for reducing the noise in a speech signal.

With this noise reducing method for the speech signal, noise suppression is achieved by adaptively controlling a maximum likelihood filter configured for calculating a speech component based upon the SNR derived from the input speech signal and the speech presence probability. This method employs a signal corresponding to the input speech spectrum less the estimated noise spectrum in calculating the speech presence probability.

With this noise reducing method for the speech signal, since the maximum likelihood filter is adjusted to an optimum suppression filter depending upon the SNR of the input speech signal, sufficient noise reduction for the input speech signal may be achieved.

However, since complex and voluminous processing operations are required for calculating the speech presence probability, it has been desired to simplify the processing operations.

SUMMARY OF THE INVENTION

It is therefore an object of the present invention to provide a noise reducing method for an input speech signal whereby the processing operations for noise suppression for the input speech signal may be simplified.

In one aspect, the present invention provides a method for reducing the noise in an input speech signal for noise suppression including converting the input speech signal into a frequency spectrum, determining filter characteristics based upon a first value obtained on the basis of the ratio of a level of the frequency spectrum to an estimated level of the noise spectrum contained in the frequency spectrum and a second value as found from the maximum value of the ratio of the frame-based signal level of the frequency spectrum to the estimated noise level and from the estimated noise level, and reducing the noise in the input speech signal by filtering responsive to the filter characteristics.

In another aspect, the present invention provides an apparatus for reducing the noise in an input speech signal for noise suppression including means for converting the input speech signal into a frequency spectrum, means for determining filter characteristics based upon a first value obtained on the basis of the ratio of a level of the frequency spectrum to an estimated level of the noise spectrum contained in the frequency spectrum and a second value as found from the maximum value of the ratio of the frame-based signal level of the frequency spectrum to the estimated noise level and from the estimated noise level, and means for reducing the noise in the input speech signal by filtering responsive to the filter characteristics.

With the method and apparatus for reducing the noise in the speech signal, according to the present invention, the first value is a value calculated on the basis of the ratio of the input signal spectrum obtained by transform from the input speech signal to the estimated noise spectrum contained in the input signal spectrum, and sets an initial value of filter characteristics determining the noise reduction amount in the filtering for noise reduction. The second value is a value calculated on the basis of the maximum value of the ratio of the signal level of the input signal spectrum to the estimated noise level, that is the maximum SNR, and the estimated noise level, and is a value for variably controlling the filter characteristics. The noise may be removed in an amount corresponding to the maximum SNR from the input speech signal by the filtering conforming to the filter characteristics variably controlled by the first and second values.

Since a table having pre-set levels of the input signal spectrum and the estimated levels of the noise spectrum entered therein may be used for finding the first value, the processing volume may be advantageously reduced.

Also, the second value is obtained responsive to the maximum SNR and the frame-based noise level, the filter characteristics may be adjusted so that the maximum noise reduction amount by the filtering will be changed substantially linearly in a dB area responsive to the maximum SN ratio.

With the above-described noise reducing method of the present invention, the first and the second values are used for controlling the filter characteristics for filtering and removing the noise from the input speech signal, whereby the noise may be removed from the input speech signal by filtering conforming to the maximum SNR in the input speech signal, in particular, the distortion in the speech signal caused by the filtering at the high SN ratio may be diminished and the volume of the processing operations for achieving the filter characteristics may also be reduced.

In addition, according to the present invention, the first value for controlling the filter characteristics may be calculated using a table having the levels of the input signal spectrum and the levels of the estimated noise spectrum entered therein for reducing the processing volume for achieving the filter characteristics.

Also, according to the present invention, the second value obtained responsive to the maximum SN ratio and to the frame-based noise level may be used for controlling the filter characteristics for reducing the processing volume for achieving the filter characteristics. The maximum noise reduction amount achieved by the filter characteristics may be changed responsive to the SN ratio of the input speech signal.

DETAILED DESCRIPTION OF THE PREFERRED EMBODIMENTS

Figure 1:
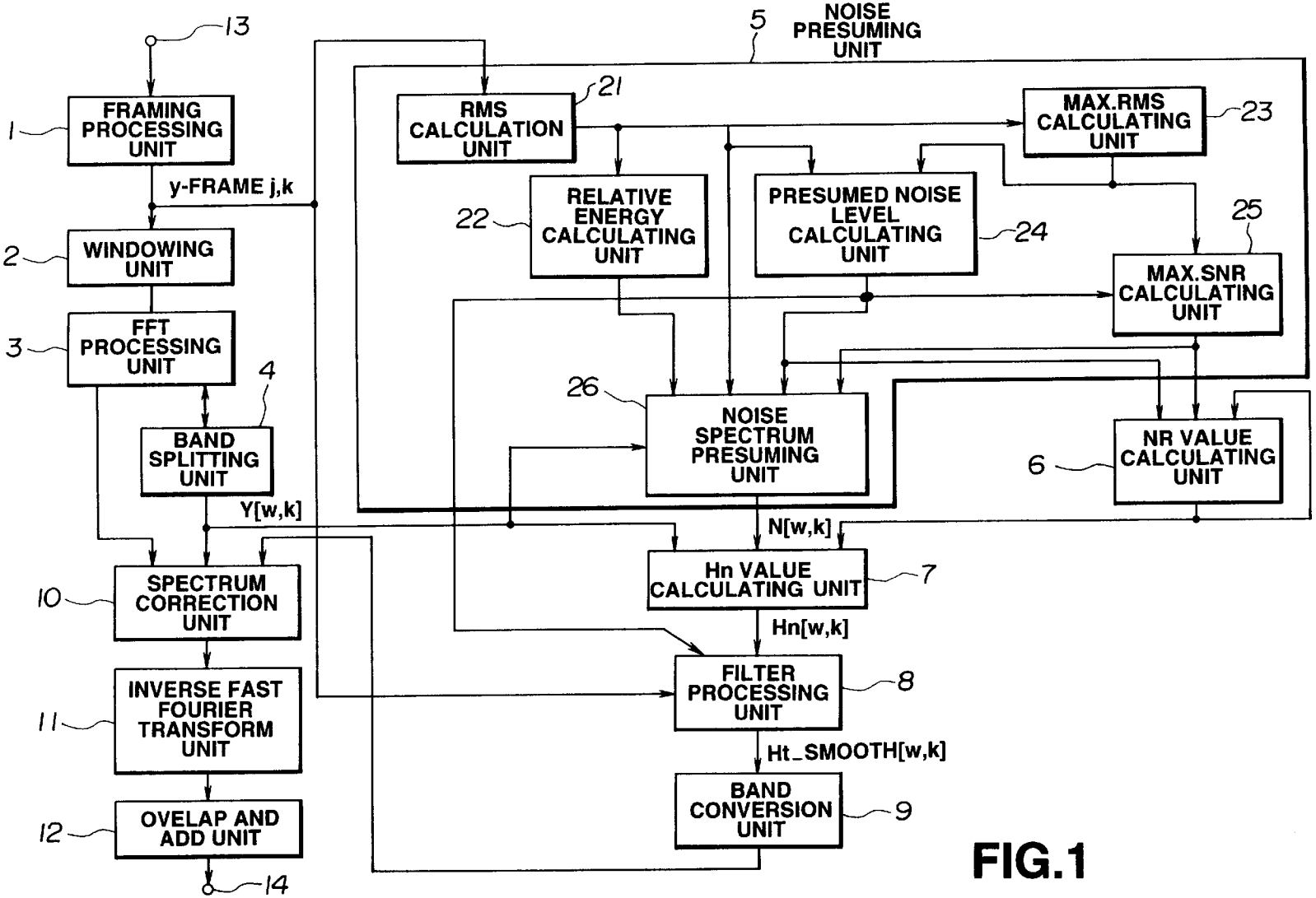
FIG. 1 illustrates a first embodiment of the noise reducing method for a speech signal of the present invention, as applied to a noise reducing apparatus.

Referring to the drawings, a method and apparatus for reducing the noise in the speech signal according to the present invention will be explained in detail.

FIG. 1 shows an embodiment of a noise reducing apparatus for reducing the noise in a speech signal according to the present invention.

The noise reducing apparatus includes, as main components, a fast Fourier transform unit 3 for converting the input speech signal into a frequency domain signal or frequency spectra, an Hn value calculation unit 7 for controlling filter characteristics during removal of the noise portion from the input speech signal by filtering, and a spectrum correction unit 10 for reducing the noise in the input speech signal by filtering responsive to filtering characteristics produced by the Hn value calculation unit 7.

An input speech signal y[t], entering a speech signal input terminal 13 of the noise reducing apparatus, is provided to a framing unit 1. A framed signal $y_frame_{j,k}$ outputted by the framing unit 1, is provided to a windowing unit 2, a root mean square (RMS) calculation unit 21 within a noise estimation unit 5, and a filtering unit 8.

An output of the windowing unit 2 is provided to the fast fourier transform unit 3, an output of which is provided to both the spectrum correction unit 10 and a band-splitting unit 4. An output of the band-splitting unit 3 is provided to the spectrum correction unit 10, a noise spectrum estimation unit 26 within the noise estimation unit 5 and to the Hn value calculation unit 7. An output of the spectrum correction unit 10 is provided to a speech signal output terminal 14 via the inverse fast Fourier transform unit 11 and an overlap-and-add unit 12.

An output of the RMS calculation unit 21 is provided to a relative energy calculation unit 22, a maximum RMS calculation unit 23, an estimated noise level calculation unit 24 and to a noise spectrum estimation unit 26. An output of the maximum RMS calculation unit 23 is provided to an estimated noise level calculation unit 24 and to a maximum SNR calculation unit 25. An output of the relative energy calculation unit 22 is provided to a noise spectrum estimation unit 26. An output of the estimated noise level calculation unit 24 is provided to the filtering unit 8, maximum SNR calculation unit 25, noise spectrum estimation unit 26 and to the NR value calculation unit 6. An output of the maximum SNR calculation unit 25 is provided to the NR value calculation unit 6 and to the noise spectrum estimation unit 26, an output of which is provided to the Hn value calculation unit 7.

An output of the NR value calculation unit 6 is again provided to the NR value calculation unit 6, while being also provided to the Hn value calculation unit 7.

An output of the Hn value calculation unit 7 is provided via the filtering unit 8 and a band conversion unit 9 to the spectrum correction unit 10.

The operation of the above-described first embodiment of the noise reducing apparatus is explained.

To the speech signal input terminal 13 is supplied an input speech signal y[t] containing a speech component and a noise component. The input speech signal y[t], which is a digital signal sampled at, for example, a sampling frequency FS, is provided to the framing unit 1 where it is split into plural frames each having a frame length of FL samples. The input speech signal y[t], thus split, is then processed on the frame basis. The frame interval, which is an amount of displacement of the frame along the time axis, is FI samples, so that the (k+1)st frame begins after FI samples as from the k'th frame. By way of illustrative examples of the sampling frequency and the number of samples, if the sampling frequency FS is 8 kHz, the frame interval FI of 80 samples corresponds to 10 ms, while the frame length FL of 160 samples corresponds to 20 ms.

Prior to orthogonal transform calculations by the fast Fourier transform unit 3, the windowing unit 2 multiplies each framed signal $y_frame_{j,k}$ from the framing unit 1 with a windowing function $w_{input}$. Following the inverse FFI, performed at the terminal stage of the frame-based signal processing operations, as will be explained later, an output signal is multiplied with a windowing function $w_{output}$. The windowing functions $w_{input}$ and $w_{output}$ may be respectively exemplified by the following equations (1) and (2):

$$W_{input}[j] = \left(\frac{1}{2} - \frac{1}{2}\cos\left(\frac{2\pi j}{FL}\right)\right)^{\frac{1}{4}}, 0 \leqq j \leqq FL \tag{1}$$

$$W_{output}[j] = \left(\frac{1}{2} - \frac{1}{2}\cos\left(\frac{2\pi j}{FL}\right)\right)^{\frac{3}{4}}, 0 \leqq j \leqq FL \tag{2}$$

The fast Fourier transform unit 3 then performs 256-point fast Fourier transform operations to produce frequency spectral amplitude values, which then are split by the band splitting portion 4 into, for example, 18 bands. The frequency ranges of these bands are shown as an example in Table 1:

TABLE 1

| band numbers | frequency ranges |
|---|---|
| 0 | 0 to 125 Hz |
| 1 | 125 to 250 HZ |
| 2 | 250 to 275 Hz |
| 3 | 375 to 563 Hz |
| 4 | 563 to 750 Hz |
| 5 | 750 to 938 Hz |
| 6 | 938 to 1125 Hz |
| 7 | 1125 to 1313 Hz |
| 8 | 1313 to 1563 Hz |
| 9 | 1563 to 1813 Hz |
| 10 | 1813 to 2063 Hz |
| 11 | 2063 to 2313 Hz |
| 12 | 2313 to 2563 Hz |
| 13 | 2563 to 2813 Hz |
| 14 | 2813 to 3063 hz |
| 15 | 3063 to 3375 hz |
| 16 | 3375 to 3688 Hz |
| 17 | 3688 to 4000 Hz |

The amplitude values of the frequency bands, resulting from frequency spectrum splitting, become amplitudes Y[w, k] of the input signal spectrum, which are outputted to respective portions, as explained previously.

The above frequency ranges are based upon the fact that the higher the frequency, the less becomes the perceptual resolution of the human hearing mechanism. As the amplitudes of the respective bands, the maximum FFT amplitudes in the pertinent frequency ranges are employed.

In the noise estimation unit 5, the noise of the framed signal $y_frame_{j,k}$ is separated from the speech and a frame presumed to be noisy is detected, while the estimated noise level value and the maximum SN ratio are provided to the NR value calculation unit 6. The noisy domain estimation or the noisy frame detection is performed a combination of, for example, three detection operations. An illustrative example of the noisy domain estimation is now explained.

The RMS calculation unit 21 calculates RMS values of signals every frame and outputs the calculated RMS values. The RMS value of the k'th frame, or RMS[k], is calculated by the following equation (3):

$$\mathrm{RMS}[k] = \sqrt{\frac{1}{FL}\sum_{j=0}^{FL-1}\left(y_\mathrm{frame}_{j,k}\right)^2} \tag{3}$$

In the relative energy calculation unit 22, the relative energy of the k'th frame pertinent to the decay energy from the previous frame, or $dB_{rel}[k]$, is calculated, and the resulting value is outputted. The relative energy in dB, that is, $dB_{rel}[k]$, is found by the following equation (4):

$$\mathrm{dB}_{rel}[k] = 10\log_{10}\left(\frac{E_{decay}[k]}{E[k]}\right) \tag{4}$$

while the energy value E[k] and the decay energy value $E_{decay}[k]$ are found from the following equations (5) and (6):

$$E[k] = \sum_{l=1}^{FL}\left(y_\mathrm{frame}_{j,k}\right)^2 \tag{5}$$

-continued $$E_{decay}[k] = \max\left(E[k], \left(\exp - \frac{FT}{0.65 * FS}\right) * E_{decay}[k-1]\right) \tag{6}$$

The equation (5) may be expressed from the equation (3) as $FL*(RMS[k])^2$. Of course, the value of the equation (5), obtained during calculations of the equation (3) by the RMS calculation unit 21, may be directly provided to the relative energy calculation unit 21. In the equation (6), the decay time is set to 0.65 second.

Figure 2:
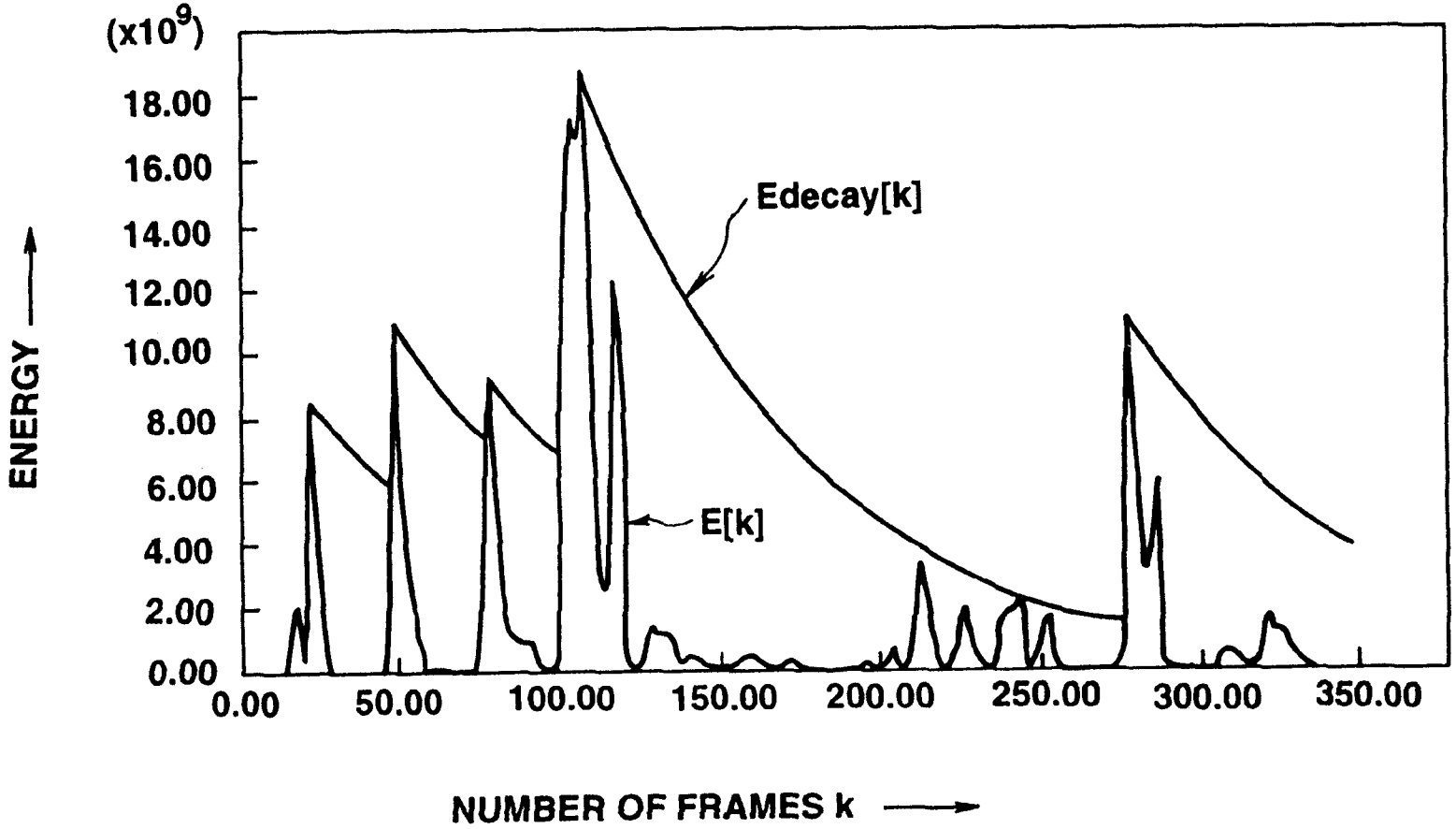
FIG. 2 illustrates a specific example of the energy E[k] and the decay energy $E_{decay}$[k] in the embodiment of FIG. 1.

FIG. 2 shows illustrative examples of the energy value E[k] and the decay energy $E_{decay}[k]$.

The maximum RMS calculation unit 23 finds and outputs a maximum RMS value necessary for estimating the maximum value of the ratio of the signal level to the noise level, that is the maximum SN ratio. This maximum RMS value MaxRMS[k] may be found by the equation (7):

$$MaxRMS[k]=max(4000, RMS[k], \theta*MaxRMS[k-1]+(1-\theta)*RMS[k])$$

where θ is a decay constant. For θ, such a value for which the maximum RMS value is decayed by 1/e at 3.2 seconds, that is θ=0.993769, is employed.

The estimated noise level calculation unit 24 finds and outputs a minimum RMS value suited for evaluating the background noise level. This estimated noise level value minRMS[k] is the smallest value of five local minimum values previous to the current time point, that is, five values sat satisfying the equation (8):

(RMS[k]<0.6*MaxRMS[k] and

RMS[k]<4000 and

RMS[k]<RMS[k+1] and

RMS[k]<RMS[k−1] and

RMS[k]<RMS[k−2]) or (RMS[k]<MinRMS) (8)

The estimated noise level value minRMS[k] is set as to rise for the background noise freed of speech. The rise rate for the high noise level is exponential, while a fixed rise rate is used for the low noise level for realizing a more outstanding rise.

Figure 3:
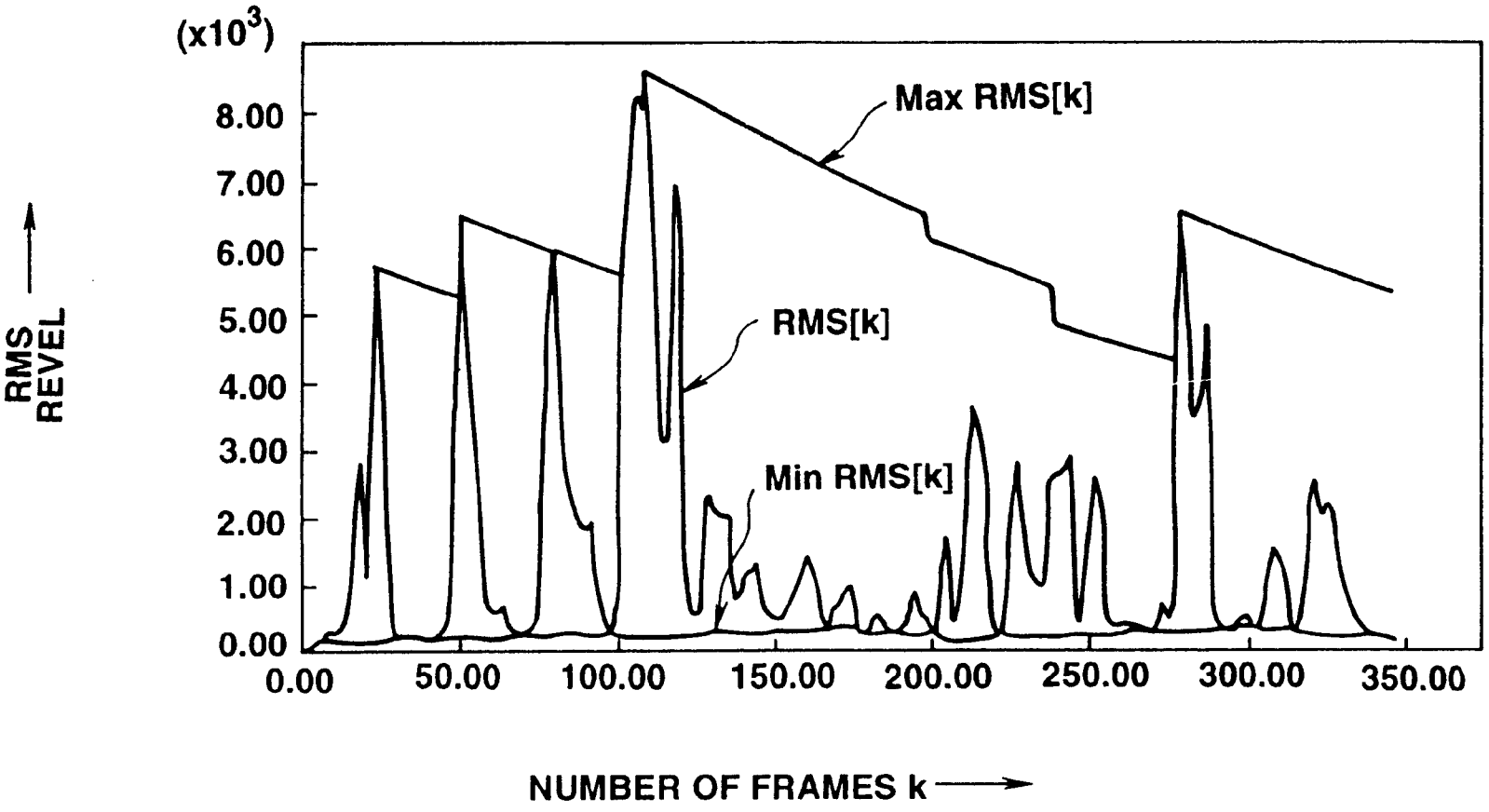
FIG. 3 illustrates specific examples of an RMS value RMS[k], an estimated noise level value MinRMS[k] and a maximum RMS value MaxRMS[k] in the embodiment of FIG. 1.

FIG. 3 shows illustrative examples of the RMS values RMS[k], estimated noise level value minRMS[k] and the maximum RMS values MaxRMS[k].

The maximum SNR calculation unit 25 estimates and calculates the maximum SN ratio MaxSNR[k], using the maximum RMS value and the estimated noise level value, by the following equation (9);

$$\mathrm{Max}SNR[k] = 20\log_{10}\left(\frac{\mathrm{MaxRMS}[k]}{\mathrm{MinRMS}[k]}\right) - 1 \tag{9}$$

From the maximum SNR value MaxSNR, a normalization parameter NR_level in a range from 0 to 1, representing the relative noise level, is calculated. For NR_level, the following function is employed:

$$NR_\mathrm{level}[k] = \tag{10}$$

-continued $$\begin{cases} \left(\frac{1}{2}+\frac{1}{2}\cos\left(\pi\frac{\mathrm{Max}SNR[k]-30}{20}\right)\right)\times\ (1-0.002(\mathrm{Max}SNR[k]-30)^2) & 30<\mathrm{Max}SNR[k]\leqq 50 \\ 0.0 & \mathrm{Max}SNR[k]>50 \\ 1.0 & \mathrm{Max}SNR[k]:\text{otherwise} \end{cases}$$

The operation of the noise spectrum estimation unit 26 is explained. The respective values found in the relative energy calculation unit 22, estimated noise level calculation unit 24 and the maximum SNR calculation unit 25 are used for discriminating the speech from the background noise. If the following conditions:

$$((\mathrm{RMS}[k]<\mathrm{NoiseRMS}_{thres}[k])\ \text{or}$$

$$(\mathrm{dB}_{rel}[k]>\mathrm{dB}_{thres}[k]))\ \text{and}$$

$$(\mathrm{RMS}[k]<\mathrm{RMS}[k-1]+200) \tag{11}$$

where $$NoiseRMS_{thres}[k]=1.05+0.45*NR_level[k]\times MinRMS[k]$$

$$dB_{thres\ rel}[k]=max(MaxSNR[k]-4.0,\ 0.9*MaxSNR[k]$$

are valid, the signal in the k'th frame is classified as the background noise. The amplitude of the background noise, thus classified, is calculated and outputted as a time averaged estimated value N[w,k] of the noise spectrum.

Figure 4:
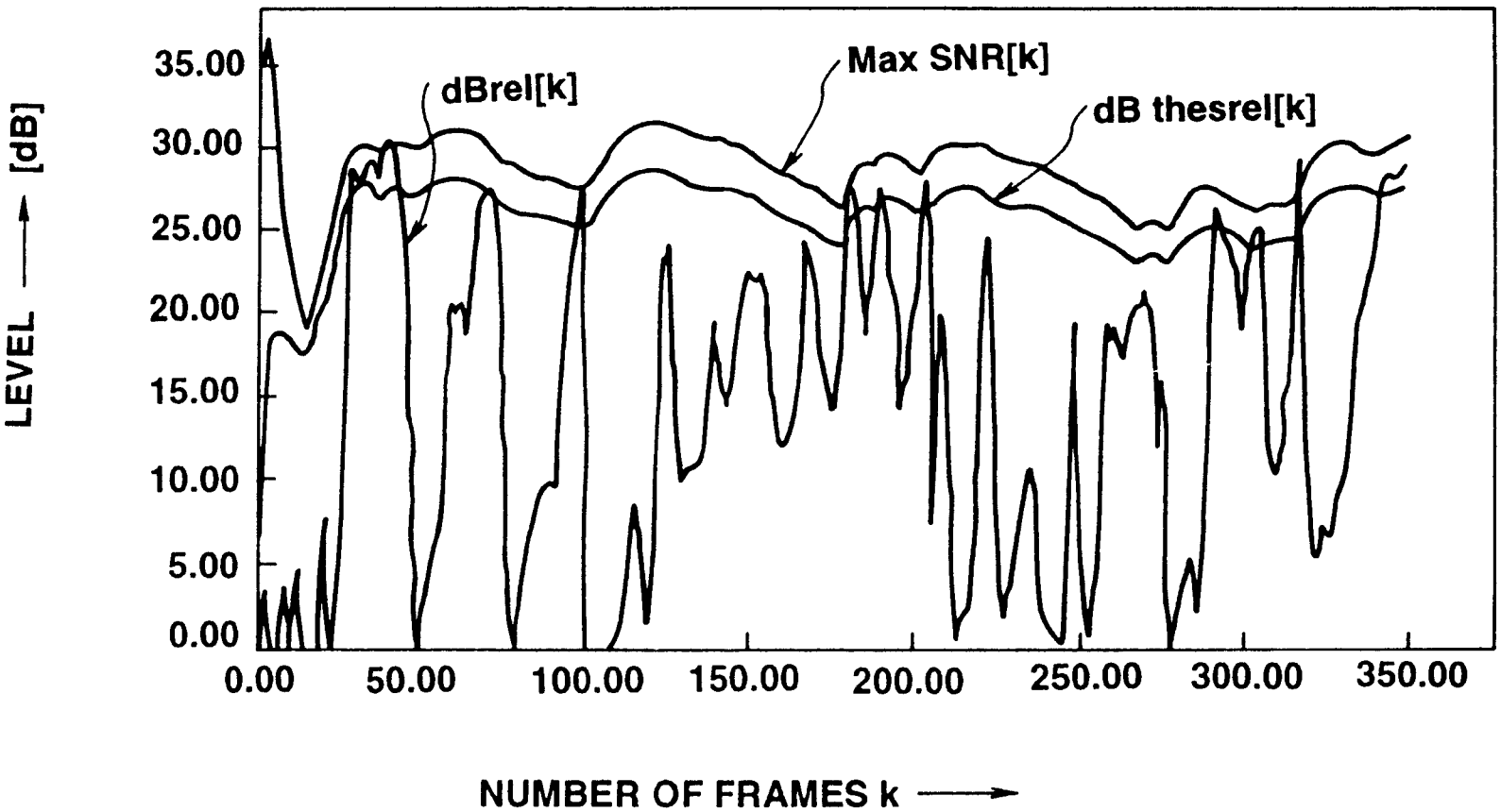
FIG. 4 illustrates specific examples of the relative energy $B_{rel}$[k], a maximum SNR MaxSNR[k] in dB, a maximum SNR MaxSNR[k] and a value $dBthres_{rel}$[k], as one of threshold values for noise discrimination, in the embodiment shown in FIG. 1.
Figure 5:
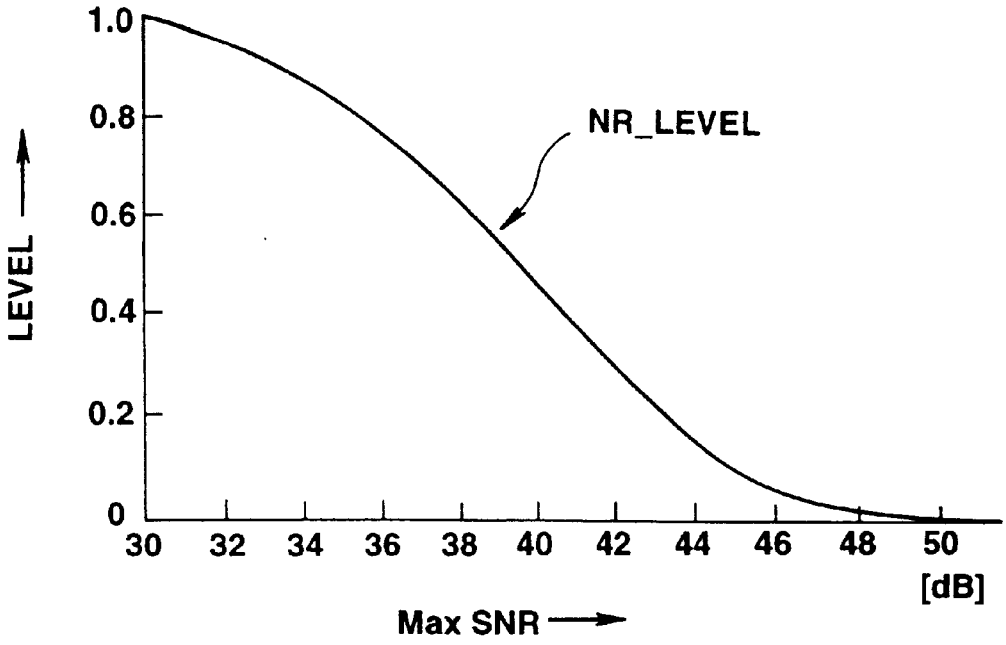
FIG. 5 is a graph showing NR_ level [k] as a function defined with respect to the maximum SNR MaxSNR[k], in the embodiment shown in FIG. 1.

FIG. 4 shows illustrative examples of the relative energy in dB, shown in FIG. 11, that is, $\mathrm{dB}_{rel}[k]$, the maximum SNR[k] and $\mathrm{dBthres}_{rel}$, as one of the threshold values for noise discrimination.

Figure 6:
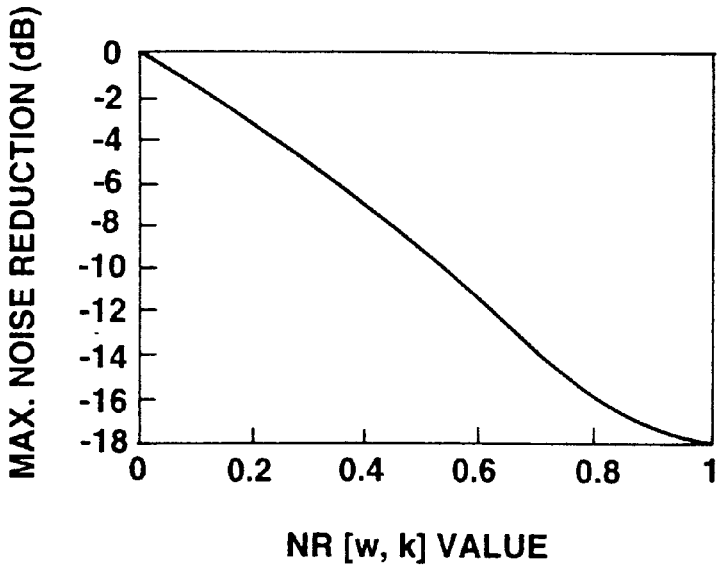
FIG. 6 shows the relation between NR[w,k] and the maximum noise reduction amount in dB, in the embodiment shown in FIG. 1.
Figure 7:
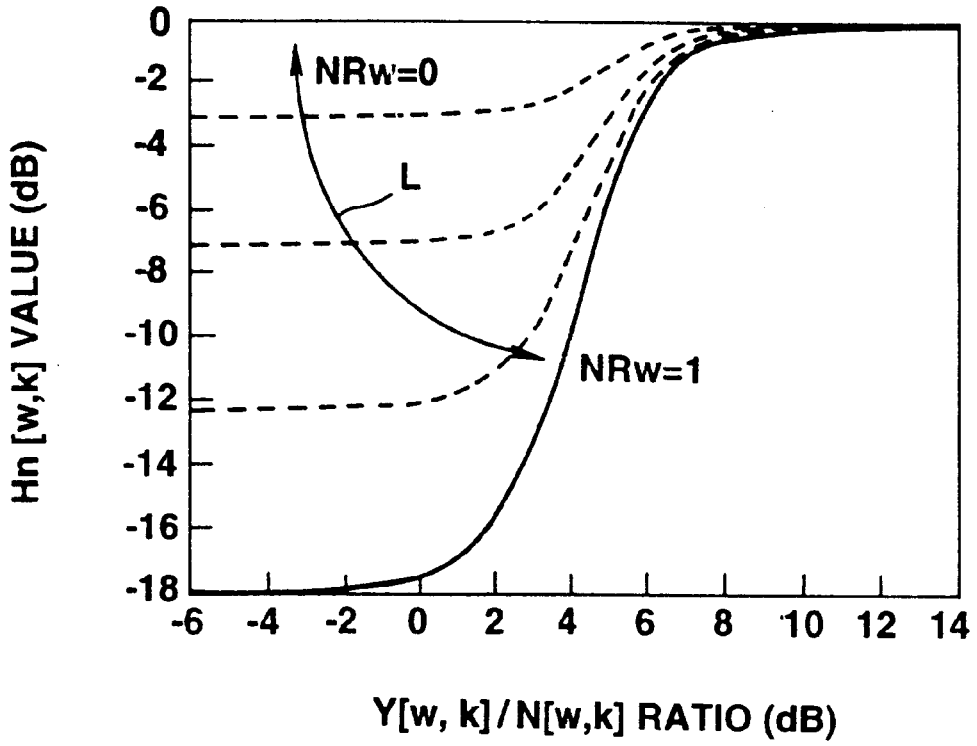
FIG. 7 shows the relation between the ratio of Y[w,k]/N [w, k] and Hn[w,k] responsive to NR[w,k] in dB, in the embodiment shown in FIG. 1.

FIG. 6 shows NR_level[k], as a function of MaxSNR[k] in the equation (10).

If the k'th frame is classified as the background noise or as the noise, the time averaged estimated value of the noise spectrum N[w,k] is updated by the amplitude Y[w,k] of the input signal spectrum of the signal of the current frame by the following equation (12):

$$N[w,k]=\alpha*\max(N[w,k-1],Y[w,k])+(1-\alpha)*\min(N[w,k-1],Y[w,k]) \tag{12}$$

$$\alpha=\exp\left(\frac{-FI}{0.5*FS}\right)$$

where w specifies the band number in the band splitting.

If the k'th frame is classified as the speech, the value of N[w,k−1] is directly used for N[w,k].

The NR value calculation unit 6 calculates NR[w,k], which is a value used for prohibiting the filter response from being changed abruptly, and outputs the produced value NR[w,k]. This NR[w,k] is a value ranging from 0 to 1 and is defined by the equation (13):

$$NR[w,k]=\begin{cases} adj[w,k] & NR[w,k-1]-\delta_{NR}<adj[w,k]<NR[w,k-1]+\delta_{NR} \\ NR[w,k-1]-\delta_{NR} & NR[w,k-1]-\delta_{NR}\geqq adi[w,k] \\ NR[w,k-1]+\delta_{NR} & NR[w,k-1]+\delta_{NR}\leqq adj[w,k] \end{cases} \tag{13}$$

$$\delta_{NR}=0.004$$

$$adj[w,k]=min(adj1[k],adj2[k])-adj3[w,k]$$

In the equation (13), adj[w,k] is a parameter used for taking into account the effect as explained below and is defined by the equation (14):

$$\delta_{NR}=0.004\ \text{and}$$

$$adj[w,k]=min(adj1[k],adj2[k])-adj3[w,k] \tag{14}$$

In the equation (14), adj1[k] is a value having the effect of suppressing the noise suppressing effect by the filtering at the high SNR by the filtering described below, and is defined by the following equation (15):

$$adj1[k]=\begin{cases} 1 & \mathrm{Max}SNR[k]<29 \\ 1-\mathrm{Max}SNR[k]-29 & 29\leqq\mathrm{Max}SNR[k]<43 \\ 0 & \mathrm{Max}SNR[k]:\text{otherwise} \end{cases} \tag{15}$$

In the equation (14), adj2[k] is a value having the effect of suppressing the noise suppression rate with respect to an extremely low noise level or an extremely high noise level, by the above-described filtering operation, and is defined by the following equation (16):

$$adj2[k]=\begin{cases} 0 & \mathrm{MinRMS}[k]<20 \\ \frac{\mathrm{MinRMS}[k]-20}{40} & 20\leqq\mathrm{MinRMS}[k]<60 \\ 1 & 60\leqq\mathrm{MinRMS}[k]<1000 \\ 1-\frac{\mathrm{MinRMS}[k]-1000}{1000} & 1000\leqq\mathrm{MinRMS}[k]<1800 \\ 0.2 & 1800\leqq\mathrm{MinRMS}[k] \end{cases} \tag{16}$$

In the above equation (14), adj3[k] is a value having the effect of suppressing the maximum noise reduction amount from 18 dB to 15 dB between 2375 Hz and 4000 Hz, and is defined by the following equation (17):

$$adj3[w,k]=\begin{cases} 0 & w<2375\,\mathrm{Hz} \\ \frac{0.059415(w-2375)}{4000-2375} & w:\text{otherwise} \end{cases} \tag{17}$$

Meanwhile, it is seen that the relation between the above values of NR[w,k] and the maximum noise reduction amount in dB is substantially linear in the dB region, as shown in FIG. 6.

The Hn value calculation unit 7 generates, from the amplitude Y[w,k] of the input signal spectrum, split into frequency bands, the time averaged estimated value of the noise spectrum N[w,k] and the value NR[w,k], a value Hn[w,k] which determines filter characteristics configured for removing the noise portion from the input speech signal. The value Hn[w,k] is calculated based upon the following equation (18):

$$Hn[w,k]=1-(2*NR[w,k]-NR^2[w,k])*(1-H[w][S/N=\gamma]) \tag{18}$$

The value H[w][S/N=r] in the above equation (18) is equivalent to optimum characteristics of a noise suppression filter when the SNR is fixed at a value r, and is found by the following equation (19):

$$H[w][S/N=\gamma]=\frac{1}{2}\left(1+\sqrt{1-\frac{1}{x^2[w,k]}}\right)*P(H1\mid Y_w)_{[S/N=\gamma]}+G_{\min}*P(H0\mid Y_w)_{[S/N=\gamma]} \tag{19}$$

Meanwhile, this value may be found previously and listed in a table in accordance with the value of Y[w,k]/N[w,k]. Meanwhile, x[w,k] in the equation (19) is equivalent to Y[w,k]/N [w,k], while $G_{min}$ is a parameter indicating the minimum gain of H[w][S/N=r]. On the other hand, P(Hi|$Y_W$)[S/N=r] and p(H0|$Y_W$[S/N=r] are parameters specifying the states of the amplitude Y[w,k] while P(H1|$Y_W$)[S/N=r] is a parameter specifying the state in which the speech component and the noise component are mixed together in Y[w,k] and P(H0|$Y_W$)[S/N=r] is a parameter specifying that only the noise component is contained in Y[w,k]. These values are calculated in accordance with the equation (20):

$$P(H1\mid Y_w)_{[S/N=\gamma]}=1-P(H0\mid Y_w)_{[S/N=\gamma]}=\frac{P(H1)*(\exp(-\gamma^2))*I_0(2*\gamma*x[w,k])}{P(H1)*(\exp(-\gamma^2))*I_0(2*\gamma*x[w,k])+P(H0)*(\exp(-x^2} \tag{20}$$

where P(h1)=P(H0)=0.5

It is seen from the equation (20) that P(H1|$Y_W$)[S/N=r] and P(H0|$Y_W$)[S/N=r] are functions of x[w,k], while $I_0$(2*r*x [w,k]) is a Bessel function and is found responsive to the values of r and [w,k]. Both P(H1) and P(H0) are fixed at 0.5. The processing volume may be reduced to approximately one-fifth of that with the conventional method by simplifying the parameters as described above.

The relation between the Hn[w,k] value produced by the Hn value calculation unit 7, and the x[w,k] value, that is the ratio Y[w,k]/N[w,k], is such that, for a higher value of the ratio Y [w,k]/N[w,k], that is for the speech component being higher than the noisy component, the value Hn[w,k] is increased, that is, the suppression is weakened, whereas, for a lower value of the ratio Y[w,k]/N[w,k], that is, for the speech component being lower than the noise component, the value Hn[w,k] is decreased, that is, the suppression is intensified. In the above equation, a solid line curve stands for the case of r=2.7, $G_{min}$=−18 dB and NR[w,k]=1. It is also seen that the curve specifying the above relation is changed within a range L depending upon the NR[w,k] value and that respective curves for the value of NR[w,k] are changed with the same tendency as for NR[w,k]=1.

The filtering unit 8 performs filtering for smoothing the Hn[w,k] along both the frequency axis and the time axis, so that a smoothed signal Ht_$_{smooth}$[w,k] is produced as an output signal. The filtering in a direction along the frequency axis has the effect of reducing the effective impulse response length of signal Hn[w,k]. This prohibits the aliasing from being produced due to cyclic convolution resulting from realization of a filter by multiplication in the frequency domain. The filtering in a direction along the time axis has the effect of limiting the rate of change in filter characteristics in suppressing abrupt noise generation.

The filtering in the direction along the frequency axis will be first explained. Median filtering is performed on Hn[w,k] of each band. This method is shown by the following equations (21) and (22):

$$\text{step 1: } H1[w,k]=max(median(Hn[w-i,k],\ Hn[w,k],Hn[w+1,k],Hn[w,k]) \tag{21}$$

$$\text{step 2: } H2[w,k]=min(median(H1[w-i,k],H1[w,k],H1[w+1,k],H1[w,k]) \tag{22}$$

If, in the equations (21) and (22), (w−1) or (w+1) is not present, H1[w,k]=Hn[w,k] and H2[w,k]=H1[w,k], respectively.

In the step 1, H1[w,k] is Hn[w,k] devoid of a sole or lone zero (0) band, whereas, in the step 2, H2[w,k] H1[w,k] devoid of a sole, lone or protruding band. In this manner, Hn[w,k] is converted into H2[w,k].

Next, filtering in a direction along the time axis is explained. For filtering in a direction along the time axis, the fact that the input signal contains three components, namely the speech, background noise and the transient state representing the transient state of the rising portion of the speech, is taken into account. The speech signal $H_{speech}$[w,k] is smoothed along the time axis, as shown by the equation (23):

$$H_{speech}[w,k]=0.7*H2[w,k]+0.3*H2[w,k-1] \tag{23}$$

The background noise is smoothed in a direction along the axis as shown in the equation (24):

$$H_{noise}[w,k]=0.7*Min_H+0.3*Max_H \tag{24}$$

In the above equation (24), Min_H and Max_H may be found by Min_H=min(H2[w,k], H2[w,k−1]) and Max_H=max(H2[w,k],H2[w,k−1]), respectively.

The signals in the transient state are not smoothed in the direction along the time axis.

Using the above-described smoothed signals, a smoothed output signal $H_{t_smooth}$ is produced by the equation (25):

$$H_{t_smooth}[w,k]=(1-\alpha_{tr})\ (\alpha_{sp}*Hspeech[w,k]+(1-\alpha_{sp})*Hnoise[w,k])+\alpha_{tr}*H2[w,k] \tag{25}$$

In the above equation (25), $\alpha_{sp}$ and $\alpha_{tr}$ may be respectively found from the equation (26):

$$\alpha_{sp}=\begin{cases}1.0 & SNR_{inst}>4.0\\ \frac{1}{3}(SNR_{inst}-1) & 1.0<SNR_{inst}<4.0\\ 0 & SNR_{inst}:\text{otherwise}\end{cases} \tag{26}$$

where $$SNR_{inst}=\frac{\mathrm{RMS}[k]}{\mathrm{MinRMS}[k-1]}$$

and from the equation (27):

$$\alpha_{sp}=\begin{cases}1.0 & \delta_{\mathrm{rms}}>3.5\\ \frac{2}{3}(\delta_{\mathrm{rms}}-2) & 1.0<\delta_{\mathrm{rms}}<3.5\\ 0 & \delta_{\mathrm{rms}}:\text{oterwise}\end{cases} \tag{27}$$

where $$\delta_{\mathrm{rms}}=\frac{\mathrm{RMS}_{local}[k]}{\mathrm{RMS}_{local}[k-1]},$$

Then, at the band conversion unit 9, the smoothing signal $H_{t_smooth}$[w,k] for 18 bands from the filtering unit 8 is expanded $$\mathrm{RMS}_{local}[k]=\sqrt{\frac{1}{FI}\sum_{j=\frac{FI}{2}}^{FL-\frac{FI}{2}}(y_\mathrm{frame}_{j,k})^2}$$

by interpolation to, for example, a 128-band signal $H_{128}$[w,k], which is outputted. This conversion is performed by, for example, two stages, while the expansion from 18 to 64 bands and that from 64 bands to 128 bands are performed by zero-order holding and by low pass filter type interpolation, respectively.

The spectrum correction unit 10 then multiplies the real and imaginary parts of FFT coefficients obtained by fast Fourier transform of the framed signal y_frame j,k obtained by FFT unit 3 with the above signal $H_{128}[w,k]$ by way of performing spectrum correction, that is noise component reduction. The resulting signal is outputted. The result is that the spectral amplitudes are corrected without changes in phase.

The inverse FFT unit 11 then performs inverse FFT on the output signal of the spectrum correction unit 10 in order to output the resultant IFFTed signal.

The overlap-and-add unit 12 overlaps and adds the frame boundary portions of the frame-based IFFted signals. The resulting output speech signals are outputted at a speech signal output terminal 14.

Figure 8:
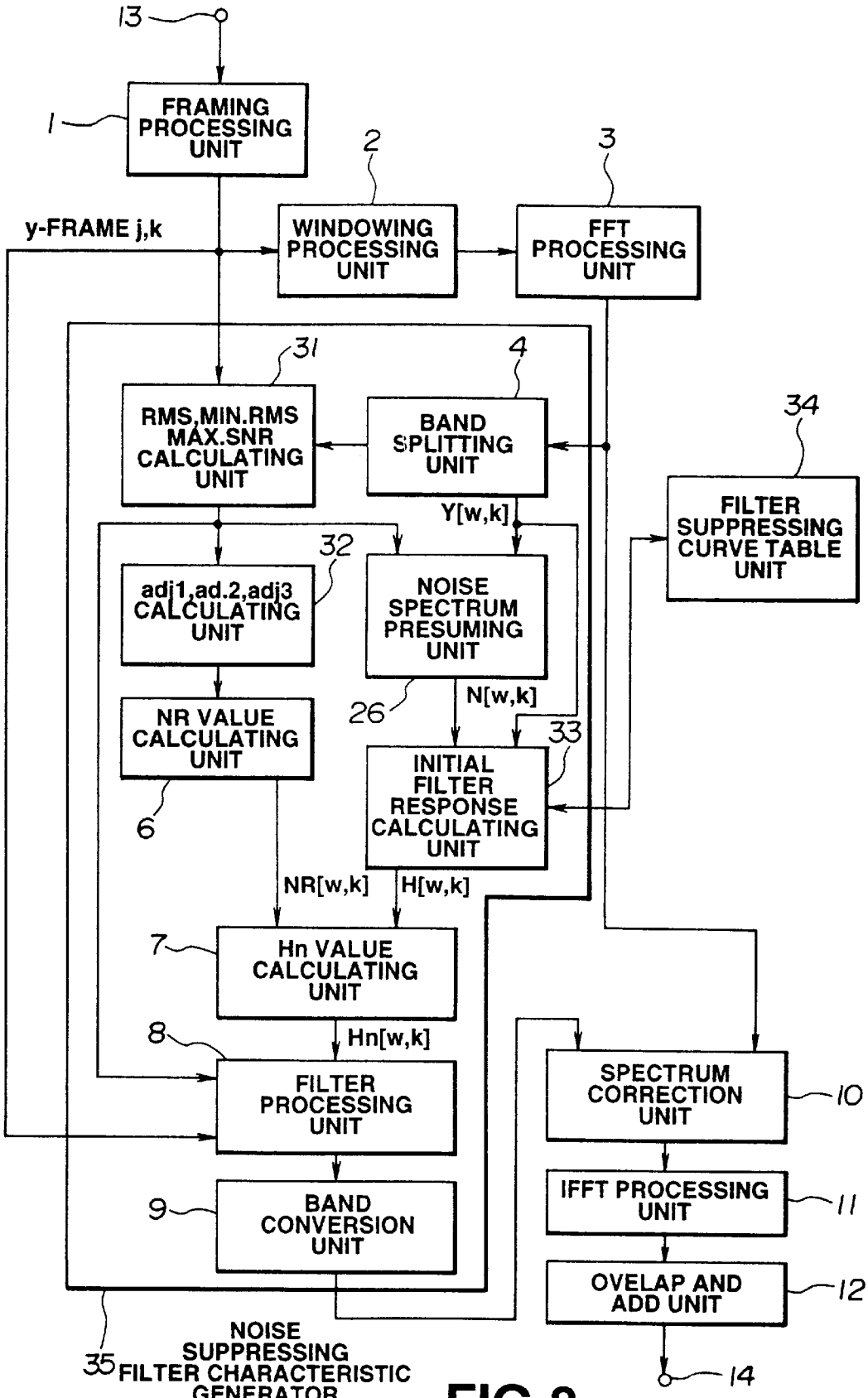
FIG. 8 illustrates a second embodiment of the noise reducing method for the speech signal of the present invention, as applied to a noise reducing apparatus.

FIG. 8 shows another embodiment of a noise reduction apparatus for carrying out the noise reducing method for a speech signal according to the present invention. The parts or components which are used in common with the noise reduction apparatus shown in FIG. 1 are represented by the same numerals and the description of the operation is omitted for simplicity.

The noise reduction apparatus has a fast Fourier transform unit 3 for transforming the input speech signal into a frequency-domain signal, an Hn value calculation unit 7 for controlling filter characteristics of the filtering operation of removing the noise component from the input speech signal, and a spectrum correction unit 10 for reducing the noise in the input speech signal by the filtering operation conforming to filter characteristics obtained by the Hn value calculation unit 7.

In the noise suppression filter characteristic generating unit 35, having the Hn calculation unit 7, the band splitting portion 4 splits the amplitude of the frequency spectrum outputted from the FFT unit 3 into, for example, 18 bands, and outputs the band-based amplitude Y[w,k] to a calculation unit 31 for calculating the RMS, estimated noise level and the maximum SNR, a noise spectrum estimating unit 26 and to an initial filter response calculation unit 33.

The calculation unit 31 calculates, from $y_frame_{j,k}$, outputted from the framing unit 1 and Y[w,k] outputted by the band splitting unit 4, the frame-based RMS value RMS[k], an estimated noise level value MinRMS[k] and a maximum RMS value Max [k], and transmits these values to the noise spectrum estimating unit 26 and an adj1, adj2 and adj3 calculation unit 32.

The initial filter response calculation unit 33 provides the time-averaged noise value N[w,k] outputted from the noise spectrum estimation unit 26 and Y[w,k] outputted from the band splitting unit 4 to a filter suppression curve table unit 34 for finding out the value of H[w,k] corresponding to Y[w,k] and N [w, k] stored in the filter suppression curve table unit 34 to transmit the value thus found to the Hn value calculation unit 7. In the filter suppression curve table unit 34 is stored a table for H[w,k] values.

The output speech signals obtained by the noise reduction apparatus shown in FIGS. 1 and 8 are provided to a signal processing circuit, such as a variety of encoding circuits for a portable telephone set or to a speech recognition apparatus. Alternatively, the noise suppression may be performed on a decoder output signal of the portable telephone set.

Figure 9:
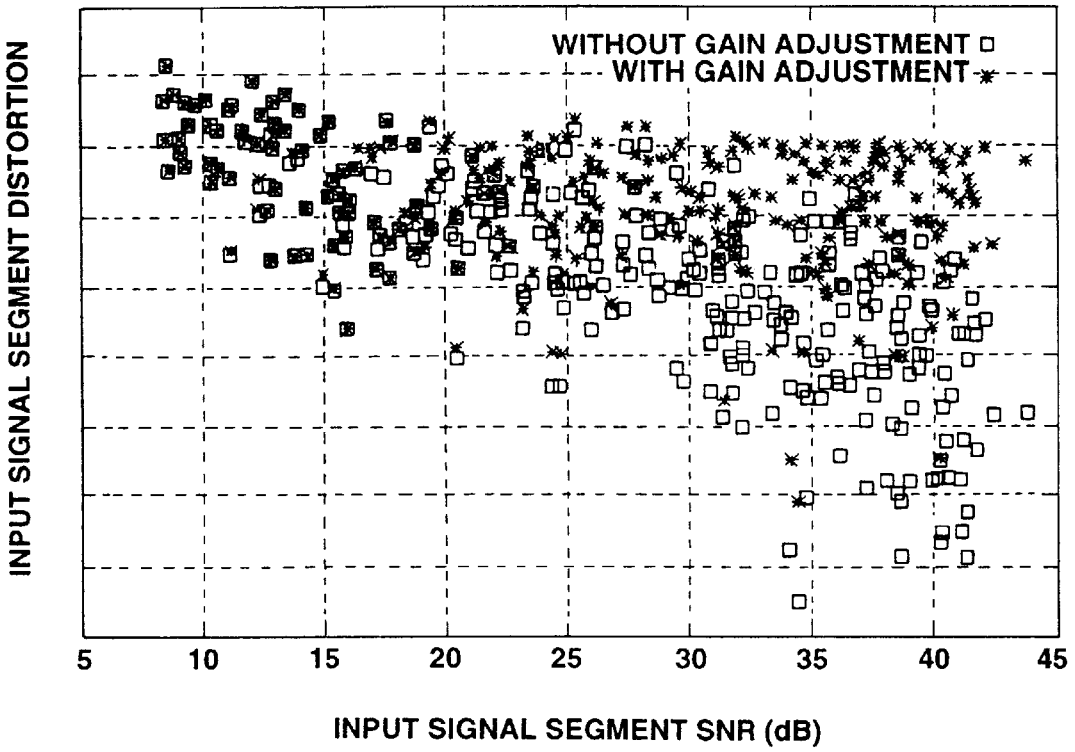
FIG. 9 is a graph showing the distortion of segment portions of the speech signal obtained on noise suppression by the noise reducing apparatus of FIGS. 1 and 8 with respect to the SN ratio of the segment portions.
Figure 10:
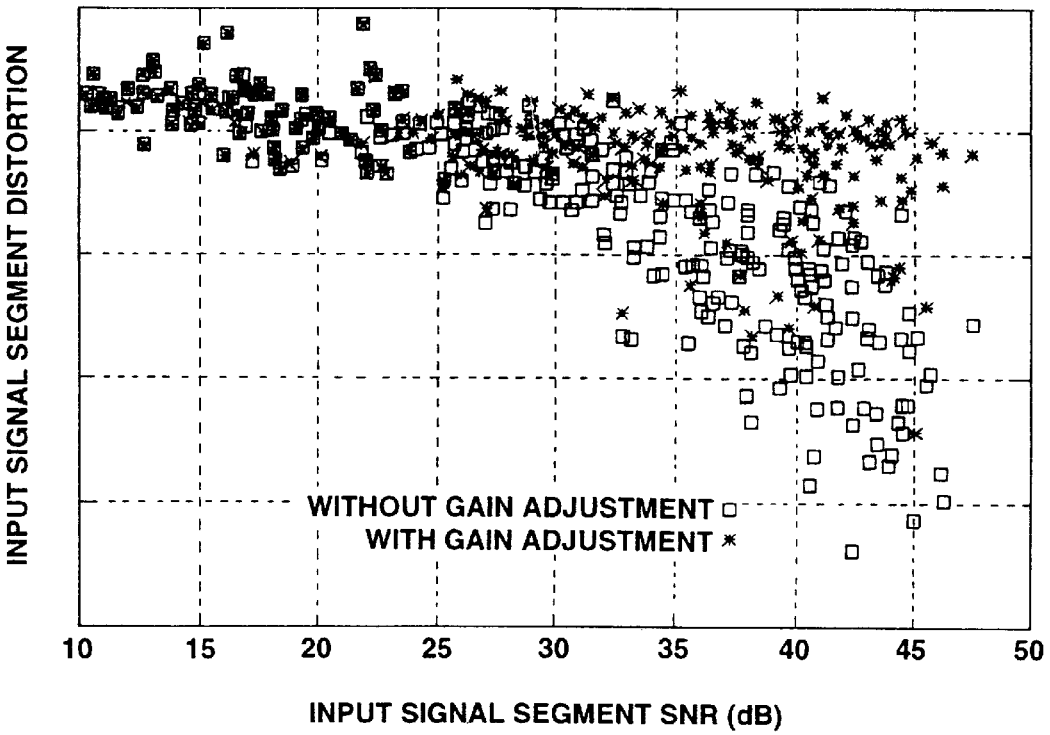
FIG. 10 is a graph showing the distortion of segment portions of the speech signal obtained on noise suppression by the noise reducing apparatus of FIGS. 1 and 8 with respect to the SN ratio of the entire input speech signal.

FIGS. 9 and 10 illustrate the distortion in the speech signals obtained on noise suppression by the noise reduction method of the present invention, shown in black, and the distortion in the speech signals obtained on noise suppression by the conventional noise reduction method , shown in white, respectively. In the graph of FIG. 9, the SNR values of segments sampled every 20 ms are plotted against the distortion for these segments. In the graph of FIG. 10, the SNR values for the segments are plotted against distortion of the entire input speech signal. In FIGS. 9 and 10, the ordinate stands for distortion which becomes smaller with the height from the origin, while the abscissa stands for the SN ratio of the segments which becomes higher toward right.

It is seen from these figures that, as compared to the speech signals obtained by noise suppression by the conventional noise reducing method, the speech signal obtained on noise suppression by the noise reducing method of the present invention undergoes distortion to a lesser extent, especially at a high SNR value exceeding 20.

What is claimed is:

1. A method for reducing noise in an input speech signal, the method comprising the steps of:

converting the input speech signal into a frequency spectrum;

determining filter characteristics by obtaining a first value representing a ratio of a signal level of the frequency spectrum to an estimated noise level of a noise spectrum contained in the frequency spectrum from a table containing a plurality of pre-set signal levels of the frequency spectrum of the input speech signal and a plurality of pre-set estimated noise levels of the noise spectrum in order to determine an initial value of the filter characteristics, and obtaining a second value representing a maximum value of a ratio of a frame-based signal level of the frequency spectrum to a frame-based estimated noise level and the frame-based estimated noise level for variably controlling the filter characteristics; and reducing noise in the input speech signal by noise filtering using the determined filter characteristics, including decreasing the noise filtering when the frame-based signal level is greater than the frame-based estimated noise level, and increasing the noise filtering when the frame-based signal level is less than the frame-based estimated noise level.

2. The method for noise reduction as claimed in claim 1, wherein the step of obtaining the second value includes obtaining a value by adjusting a maximum noise reduction amount by noise filtering based on the determined filter characteristics so that a maximum noise reduction amount changes substantially linearly in a dB domain.

3. The method for noise reduction as claimed in claim 1, further comprising the steps of:

obtaining the frame-based estimated noise level based on a root mean square value of an amplitude of the frame-based signal level and a maximum value of root mean square values; and calculating the maximum value of the ratio of the frame-based signal level to the frame-based estimated noise level based on the maximum value of the root mean square values and the frame-based estimated noise level, wherein the maximum value of the root mean square values is a maximum value among root mean square values of amplitudes of the frame-based signal level and a value obtained based on the maximum value of the mean root mean square values of a directly previous frame and a pre-set value.

4. An apparatus for reducing noise in an input speech signal and for performing noise suppression, the apparatus comprising:

means for converting the input speech signal into a frequency spectrum;

means for determining filter characteristics based upon a first value representing a ratio of a signal level of the frequency spectrum to an estimated noise level of a noise spectrum contained in the frequency spectrum obtained from a table containing a plurality of pre-set signal levels of the frequency spectrum of the input speech signal and a plurality of pre-set estimated noise levels of the noise spectrum in order to determine an initial value of the filter characteristics, and a second value representing a maximum value of a ratio of a frame-based signal level of the frequency spectrum to a frame-based estimated noise level of the noise spectrum and the frame-based estimated noise level of the noise spectrum for variably controlling the filter characteristics; and means for reducing noise in the input speech signal by noise filtering responsive to the determined filter characteristics, wherein the noise filtering is decreased when the frame-based signal level is greater than the frame-based estimated noise level, and the noise filtering is increased when the frame-based signal level is less than the frame-based estimated noise level.

* * * * *